United States Patent [19]

Cochran

[11] 4,254,785

[45] Mar. 10, 1981

[54] HAIR ROLLER FASTENER

[76] Inventor: Charles R. Cochran, 120 S. Virginia St., Prescott, Ariz. 86301

[21] Appl. No.: 67,274

[22] Filed: Aug. 17, 1979

[51] Int. Cl.[3] ..... A45D 6/16; A45D 8/06

[52] U.S. Cl. ..... 132/40; 132/50 R

[58] Field of Search ..... 132/40 R, 41 R, 41 A, 132/42 R, 46 R, 46 A, 50 R, 50 B, 52; 24/49 C, 67.9

[56] References Cited

U.S. PATENT DOCUMENTS

| | | | |
|---|---|---|---|
| 1,599,338 | 9/1926 | Loyd | 24/49 C |
| 1,711,908 | 5/1929 | Smith | 132/50 R |
| 3,654,937 | 4/1972 | Meeks | 132/40 |
| 3,927,685 | 12/1975 | Bontempi | 132/40 |

FOREIGN PATENT DOCUMENTS

| | | | |
|---|---|---|---|
| 2223276 | 11/1972 | Fed. Rep. of Germany | 132/40 |
| 115080 | 10/1945 | Sweden | 24/67.9 |
| 254987 | 7/1926 | United Kingdom | 132/50 B |

*Primary Examiner*—Paul J. Hirsch
*Attorney, Agent, or Firm*—Paul H. Gallagher

[57] ABSTRACT

A fastener used with a roller for curling hair, formed from a single length of spring steel, folded over in double-bend, or double-loop shape, having a main first component forming a long leg, and another short, double component forming in effect a short leg biased against the long leg. A first bend is formed between the two components, and a second bend is formed between the elements of the second component, one of which directly engages the long leg of the main component. The second bend in the double component forms a bight or diverging space between itself and the main component for receiving the roller and hair wrapped on it. Both components have upturned tip ends or extremities for facilitating receiving the roller and the hair rolled on it, in applying the fastener. The strip from which the pin is formed is substantially wider than it is thick, to form flat elements to stabilize the fastener in position on the roller/hair.

3 Claims, 6 Drawing Figures

HAIR ROLLER FASTENER

OBJECTS OF THE INVENTION

The broad object and purpose of the invention is to provide a new fastener for use in conjunction with a roller, in curling hair, and a method of curling the hair, embodying the following features:

(a) It is extemely simple, and hence inexpensive, both in the material making it up and in the steps of fabricating it.

(b) It is simple and effective to use, having elements forming legs biased toward each other, and which are spread by the action of applying the fastener in place, in the use of which it can be applied more quickly and easily, and more effectively than in the case of other kinds of devices used heretofore. The fastener is applied in operative position by merely pushing it into place, and the preliminary manipulation of spreading the elements thereof is eliminated, and the danger of breaking the fingernails, which was always a hazard heretofore, is eliminated.

(c) The fastener is formed from a piece of flat steel whereby the elements of the fastener itself are flat, accommodating the biasing interaction between the elements in gripping the roller and hair, and whereby the fastener is more stable when in position in a hair curling operation, and the step of applying the fastener in place is thereby rendered easier.

DESCRIPTION OF A PREFERRED EMBODIMENT

Figure 1:
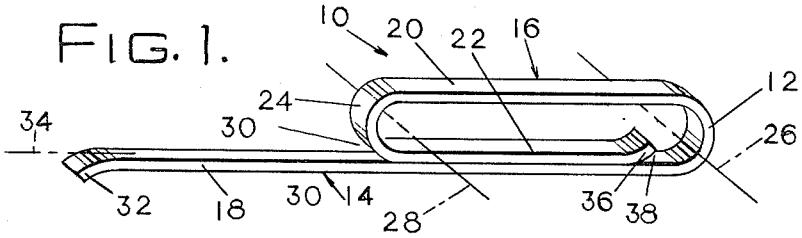
FIG. 1 is a perspective view of the hair roller fastener made according to the present invention.

Referring in detail to the drawing, attention is directed first to FIG. 1 showing the fastener of the invention in perspective view. The fastener indicated in its entirety at 10 is formed from a single, integral spring steel strip, flat in shape, i.e., having a transverse width greater than its thickness. The steel piece is bent at a mid portion forming a first bend 12 between two main components 14 and 16. The component 14 constitutes what also is referred to as a first element or leg 18, this element being relatively long. The component 16 includes a second element 20 and a third element 22, the third element being also referred to as a leg. This component 16 as shown in FIG. 1 is substantially shorter than the component 14, and in the present instance is in the neighborhood of one half that length. Formed between and interconnecting the second and third elements, 20, 22, is a second bend 24. FIG. 1 shows an axis 26 about which the bend 12 is shaped and an axis 28 about which the bend 24 is shaped, these axes extending transversely of the fastener, and along the flat surfaces thereof, and thus the various elements of the fastener have flat surfaces directed toward each other.

The relative dimensions of the various parts of the fastener are not critical, that is, the greater transverse width need not be precise relative to the thickness, the consideration being that the fastener has flat surfaces which are directed toward each other, and these flat surfaces interengage so as to stabilize the pin in its active, operative position.

The bends 12, 24 also need not be of any particular shape, but in the usual and known steps in the formation of such a device, the bends would be arcuate, or nearly so. The bend 12 is prestressed inwardly about the axis 26 so as to constantly bias the component 16 toward the component 14. For a similar purpose the bend 24 is prestressed outwardly of its axis 28, thereby biasing the third element 32 against the first element 18.

Due to the close proximity of the third element or leg 22 to the first element or long leg 18, the bend 24 forms a bight or diverging space 30 between those elements. This bight facilitates putting the fastener in active position as will be referred to again hereinbelow.

The first element 18 or long leg has a tip end or extremity 32 at its free end bent downwardly, i.e, away from a line 34 which extends along the element 18 and between that element and the third element 22. Similarly the third element 22 has a tip end or extremity 36 bent upwardly, or away from the first element 18. This tip end 36 forms a bight or diverging space 38 between itself and the element 18, also facilitating placement of the fastener on or removal from the roller.

Figure 2:
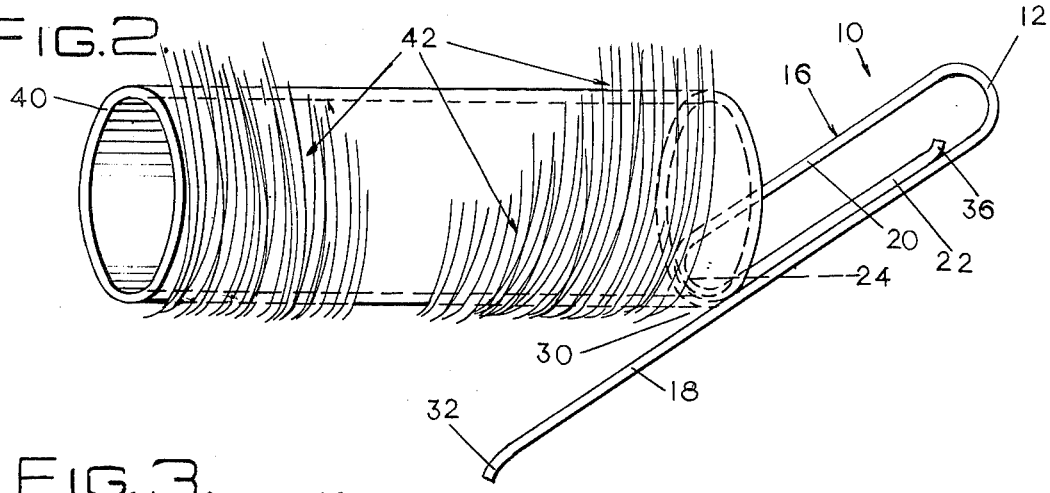
FIG. 2 shows the fastener in conjunction with a roller on which hair is rolled, in a preliminary step in applying the fastener in positon.

A roller is illustrated at 40 which may be a simple straight tubular roller. In the process of curling the hair, a tuft or quantity of hair indicated at 42 is grasped by the fingers and held out from the head in taut condition and the end of the tuft is applied to the roller and the roller turned and the hair rolled up thereon. Then the fastener 10 is applied to the roller with the hair rolled thereon in the steps indicated in FIGS. 2, 3 and 4. As represented in FIG. 2 the roller with the hair thereon is held in place by one hand and the fastener grasped by the other and positioned with the long element or leg 18 outwardly of the roller and the component 16 disposed radially inwardly of the wall of the roller. In this step, the fastener is ordinarily at quite an angle to the roller to facilitate insertion of the edge of the wall of the roller into the bight 30. The user then pushes the fastener longitudinally of the roller, to the left as illustrated in FIG. 2, and as it is so moved, the roller/hair produces a camming action, spreading the end of the component 16 away from the long leg 18 and enabling the component 16 to ride into the interior of the roller.

Figure 3:
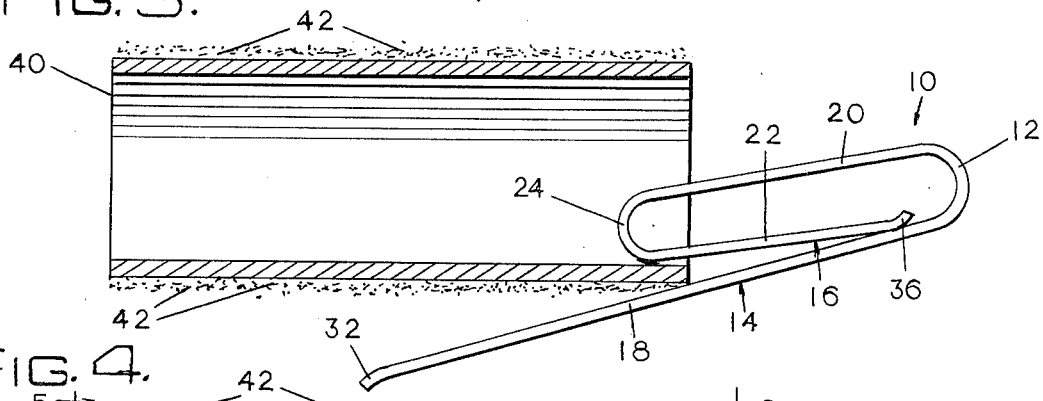
FIG. 3 represents a step beyond that of FIG. 2 applying the fastener in position, and showing the roller and hair thereon in section.
Figure 4:
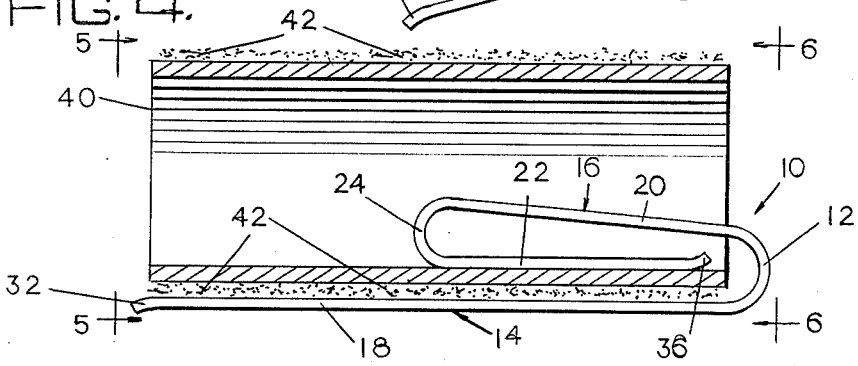
FIG. 4 is a view similar to FIG. 3 but with the fastener moved to its fully applied position.
Figure 5:
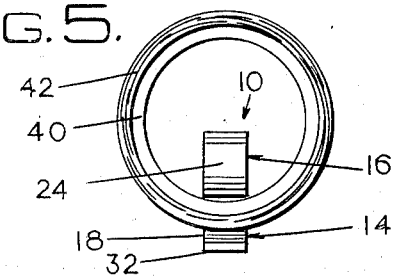
FIG. 5 is an end view, taken at line 5–5 of FIG. 4.
Figure 6:
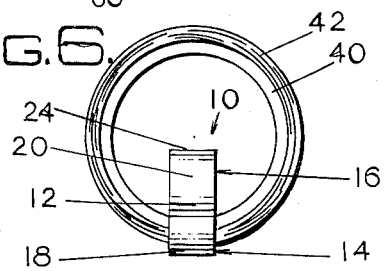
FIG. 6 is an end view taken at line 6—6 of FIG. 4.

In an initial portion of the step represented in FIG. 3, as the bend 24 spreads or separates from the long leg 18, the trailing end of the second element 22 continues to engage the long leg 18, at least for a portion of the movement, but as the movement continues the third element or leg 22 rides up on the inner surface of the roller and continues in that action until the fastener reaches its final positon as represented in FIG. 4. In the position shown in FIG. 4 the component 16 as a whole is in an angular position relative to the long leg 18, but more specifically the second element 20 assumes such an angular position, flexing the bend 12 outwardly, but the prestressed condition of this bend continues to bias the component inwardly, or toward the element 18. In a correlative manner, the bend 24 by its prestressed condition retains the third element 22 in constant engagement with the inner surface of the wall of the tube. In this position of the fastener, it will be seen that the third element 22 remains flat against the inner surface of the wall of the tube.

In this step of applying the fastener to active position, the tip end 32 forms a diverging space similar to the space 30, and aids in wedging the hair on the roller into the space between the long leg 18 and the roller. This minimizes or substantially eliminates accidental catching or snagging of the hair by the end of the leg as may otherwise occur, and confines it and wedges it into the space as mentioned.

The tip end 36 performs a similar function in removing the fastener from position. If a protuberance, or any hair should occur in the roller/hair between that tip end and the bend 12, it would be confined in the space 38 upon removal of the fastener without catching or snagging by the end of the element 22.

In putting the fastener in position, the rounded surface of the bend 24 engages the surface of the roller at a point on the bend adjacent its mid-point, and as the fastener is progressively moved into positon, it assumes a position at a lesser angle to the roller axis (FIG. 3) proceeding through a rocking motion, and the bend engages the roller at a point more removed from its own mid-point. This action continues throughout the placement of the fastener until it assumes its final position represented in FIG. 4 in which only the element or finger 22 engages the roller surface, and it does so flatly. Thus the band 24 serves as an effective fulcrum element, acting smoothly and never at any time digging into or scraping the roller surface.

In the final increments of movement of the fastener into operative position and even before reaching the final position of FIG. 4, as the main element reaches, or closely approaches, flat position, the tip end 32 rides over the hair, in the manner stated, and prevents snagging of it.

The flat shape of the various elements making up the fastener provides great stability to the fastener and retains it in proper active position on the roller/hair. The flat surfaces engage against the inner surface of the roller and the outer surface of the hair on the roller, and the fastener is thus held against wobbling or angular displacement (about a longitudinal axis), but moreover, the long element or leg 18 is held flat against the hair throughout its own length and aids in maintaining the rolled hair in snug and compact position. As another aspect of the stability of the fastener provided by the flat surfaces, the fastener possesses a substantial dimension transverse to the flat surfaces, i.e., vertically as viewed in FIGS. 1–4 or in the direction of the spacing between the elements 20, 18, this spacing or dimension being characteristic of the provision of the bends 12 and 24, and notwithstanding this spacing or dimension, the fastener is retained in perfect stabilized position.

A novel and very effective feature of the fastener is the inter-relation between the bends 12 and 24. These bends are "in series" between the legs 18 and 22 which are the ultimate end elements that engage and grip the things that are to be held—the roller and hair. They cooperate to maintain the legs both flat against the roller/hair.

Another advantageous effect in the functioning of the fastener is the long length of the element or leg 18 and the relatively short length of the component 16. The leg 18 is dimensioned the same as or similar to the axial length of the roller so that it engages the hair through out the length of the roller and retains the hair in snug-rolled condition as mentioned above, and this firm engagement or holding effect of the long leg 18 is produced by the constant compression effect by the component 16. The component 16 possesses great strength and is effective for holding the long leg 18 in it position as stated, notwithstanding the long length of the leg 18 and the relatively shorter length of the component 16.

I claim:

1. A hair roller fastener comprising, a member formed of a single piece of spring steel and including a first component and a second component interconnected by a first bend, the first component being relatively long, and constituted by a single element forming a first leg, the second component being relatively short and consituted by a pair of single elements that form a second leg and a third leg interconnected by a second bend, both of said bends being continuous curves of substantial radius, all of said legs being straight, and in the absence of anything between the components, being parallel, the first bend being prestressed inwardly to bias the second component toward the first component and the second bend being prestressed outwardly to bias the third leg toward the first leg, the prestressed conditions of the bends being effective for positioning the third leg into engagement of the first leg throughout the length of the third leg in the absence of anything between those legs, and to bias those legs toward parallelism in the presence of anything between those legs, the second bend and the first leg forming between themselves a bight for receiving objects and guiding them into position between the third leg and first leg, and the second bend being positioned remote from the free end of the first whereby the portion of the first leg beyond the second bend, and the curved surface of the second bend, form the surfaces defining the bight and are remote from any pointed element of the fastener, whereby, further, the fastener can be easily to a roller with hair rolled thereon without snagging the hair.

2. A hair roller fastener according to claim 1 wherein, the spring steel piece from which the fastener is formed has a transverse width substantially greater than its thickness, possessing a generally flat shape, and the bends are shaped around axes extending transversely of the piece, whereby the legs have flat and broad surfaces directed toward each other.

3. A hair roller fastener according to claim 1 wherein, the first leg at its free end has a tip bent away from a line following the first leg and positioned between the first and third legs, and the third leg at its free end has a tip bent away from the first leg.

* * * * *